United States Patent [19]

Thomas

[11] Patent Number: 4,572,529

[45] Date of Patent: Feb. 25, 1986

[54] ROLLER SKATE

[76] Inventor: Perry W. Thomas, 12708 12th St., Grandview, Mo. 64030

[21] Appl. No.: 694,786

[22] Filed: Jan. 25, 1985

Related U.S. Application Data

[63] Continuation of Ser. No. 445,004, Nov. 29, 1982, abandoned.

[51] Int. Cl.[4] ..... A63C 17/24; A63C 17/04

[52] U.S. Cl. ..... 280/11.1 BR; 280/11.22

[58] Field of Search ..... 280/11.1 BR, 11.22, 280/11.19, 11.27, 11.1 BT

[56] References Cited

U.S. PATENT DOCUMENTS

| | | | |
|---|---|---|---|
| 904,088 | 1/1908 | Rother | 280/11.1 BR |
| 2,145,219 | 1/1939 | Burton | 280/11.22 |
| 2,150,814 | 3/1939 | Barbato | 280/11.27 |
| 3,306,623 | 2/1967 | Weitzner | 280/11.19 |

FOREIGN PATENT DOCUMENTS

| | | | |
|---|---|---|---|
| 710 | of 1876 | United Kingdom | 280/11.1 BR |
| 2038644 | 7/1980 | United Kingdom | 280/11.1 BR |

*Primary Examiner*—Joseph F. Peters, Jr.
*Assistant Examiner*—Joseph G. McCarthy
*Attorney, Agent, or Firm*—Kokjer, Kircher, Bradley, Harton, Bowman & Johnson

[57] ABSTRACT

A roller skate construction including two pairs of spherical rollers generally supporting a skate frame proximal the toe and ball of the skater's foot, and a conventional pair of skate wheels supporting the heel region of the skate frame. The intermediate pair of spherical rollers are of slightly larger diameter than the forwardmost pair thereof to permit the skater to rock forwardly on the skates and disengage the wheels from the skating surface when desired.

8 Claims, 2 Drawing Figures

ROLLER SKATE

Figure 1:
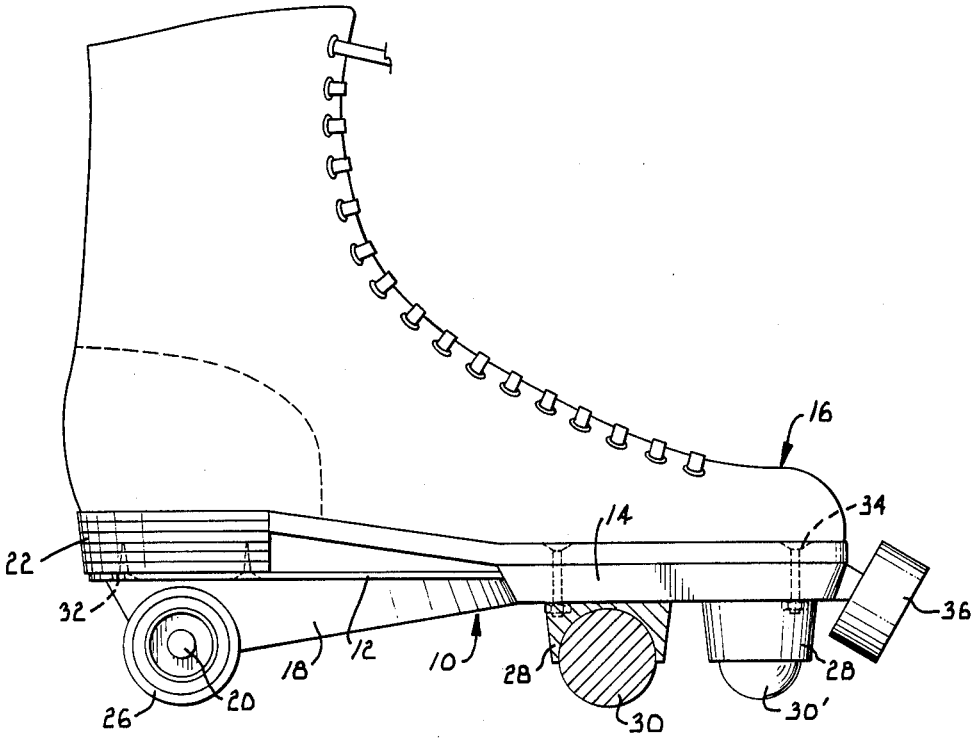

This is a continuation of my co-pending application Ser. No. 445,004, filed Nov. 29, 1982, now abandoned.

This invention pertains to roller skate construction, and more particularly to a novel construction for the roller assembly for skates which construction affords the user considerably more versatility of movement while skating than has been conventional.

Heretofore, roller skates have generally been constructed to present two pairs of wheel assemblies mounted on a frame or the base of a skate shoe. Such construction affords the necessary fore and aft gliding movement to permit the wearer to skate, but lateral motion has been largely restricted and is available to the skater by shifting his weight to the rollers on one or the other side of the assembly. Various means have been tried to increase the amount of lateral movement to the skater. Pivoting bolsters have been attempted and even spherical rollers have been suggested.

While various modifications have permitted greater acrobatic skating movements than is available from constructions wherein the rollers are all mounted on fixed axles for strictly fore and aft rolling movement, all constructions previously advanced of which applicant is aware have certain drawbacks. For example, the pivoting bolsters still limit lateral movement and the resultant inclination of the edges of the flat rollers causes a tendency for the rollers to "bite" into the skating surface. This may result in a jerky or halting motion for the skater. Where spherical rollers have been used in the past, the skater generally has too little control over the skate motion for desired skating movements.

It is therefore a primary object of this invention to provide a skate construction which permits improved motion for the skater, yet which enhances the control which the skater has over such movements.

It is another object of the present invention to provide a skate construction wherein the wearer can change between virtually unrestricted lateral motion to limited lateral motion simply by shifting his weight on the skate.

A further important object of the invention is to provide a construction which combines the use of wheel rollers and ball rollers in a manner to enhance the ability of a user to control his skating movements.

Still another object of the invention is to provide a novel combination of rollers of different diameters so that the skater will be able to quickly and easily shift between various kinds of support while skating in order to enhance the skating maneuvers.

Figure 2:
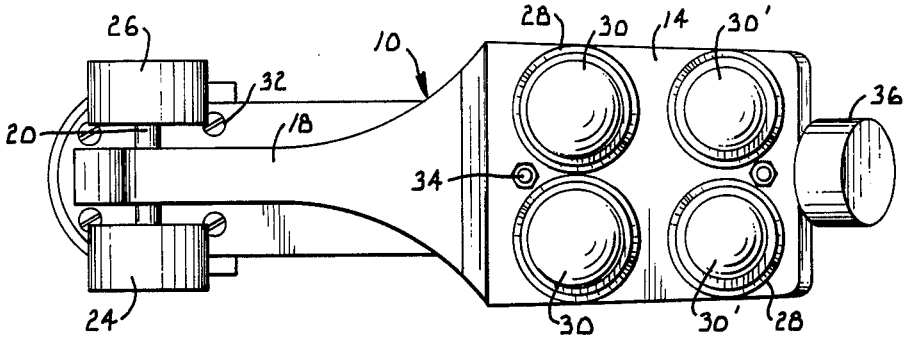

These and other important aims and objectives of the invention will be further set forth or will become apparent from the following specification and explanation of the drawing, wherein:

FIG. 1 is a side elevational view of a skate mounted on a skate shoe and embodying the principles of this invention, certain parts being shown in cross-section to reveal details of construction; and FIG. 2 is a bottom plan view thereof.

A roller skate embodying the principles of this invention is broadly designated by the reference numeral 10 and includes an elongated rigid frame 12 having a thickened portion 14 underlying the forward region of a skate shoe 16. An elongated, rigid, tapered section 18 is integral with portion 14 and extends downwardly and rearwardly to provide a journal for a laterally extending shaft 20. Shaft 20 is disposed directly beneath the heel 22 of shoe 16 as shown in FIG. 1 of the drawing. A pair of wheel rollers 24 and 26 are mounted for rotation on shaft 20 in conventional fashion and serve to support the weight from the heel portion of the skater.

The forward portion 14 of the skate is supported by two pairs of side by side spherical balls 30 and 30', each ball being supported in its respective socket 28 so that each ball is permitted rolling movement in all directions. Each ball 30 is slightly greater in diameter than each ball 30'.

Frame 18 is rigidly secured to the lowermost surface of the shoe 16 by means such as screws 32 and bolts 34. A toe pad 36 may be secured to frame 18 at the forward end of the latter as is conventional.

In operation, the rolling movement affored by balls 30 and 30', as well as wheels 24 and 26, permit the gliding movement over a skating surface responsive to movements of the skater's body which is required for skating. If the skater desires to move in a generally forward or rearward motion, the skater applies weight to the heel portion of the shoe as well as to the forward pairs of spherical rollers. Wheels 24 and 26 generally limit the skater to forward or rearward movement because of the shaft mounting of the wheel rollers. The shaft mounted wheels serve to guide and stabilize the skate. On the otherhand, when the skater desires more lateral movement than is ordinarly permitted with shaft mounted wheels, the skater simply applies less weight to the heel portion and more to the ball of the foot. This provides the support for the skater primarily through the spherical rollers and the latter permit movement in any direction dependent upon the manner in which the skater moves his body.

The forward spheres 30' are each smaller in diameter than each of the rearward pair of spheres 30. This particular construction permits the skater to rock the rigid skate frame 12 forwardly about the pivot afforded by the larger spheres 30 to slightly elevate the wheels 24 and 26 off the skating surface. This slight rocking action greatly enhances the ability of the skater to move in any desired direction supported substantially only by the spheres. This gives the skater a far greater range of movement than would be possible if the wheels remained firmly engaged against the skating surface at all times.

On the otherhand, it has been found that the wheels 24 and 26 are important for skates of this kind in order to provide the necessary control over skating movement to the skater. The skater needs this control which the wheels afford to limit the extent of lateral movement when he desires. This can be accomplished simply by rocking back on his heels, firmly engaging the wheels against the skating surface. Toe pad 36 at the front of the skate can also be engaged against the skating surface as desired and as required by the skater.

The skate embodying the principals of this invention permits a greater versatility of skating movement than heretofor possible, including the ability to rather easily perform acrobatic manuevers. The skate construction enhances the skater's control required for successful accomplishment of such manuevers.

I claim:

1. A roller skate for a skater's shoe, said skate comprising:

an elongated, rigid frame adapted to be secured in supporting relationship beneath the shoe sole;

a first support roller device secured to the frame and projecting downwardly therefrom in disposition to engage a skating surface, said first device including an axle secured to the frame and extending transversely thereof, and a wheel journalled on the axle for only fore and aft rolling motion with respect to the frame;

a second support roller device secured to the frame in longitudinally spaced apart relationship forwardly along the frame from said first device, said second device including a socket member secured to the frame, there being a semi-spherical cavity in the socket member, and a sphere complementally received in the cavity for rolling movement in any direction, said sphere projecting from the cavity and downwardly from the frame in disposition to engage said skating surface and;

a third roller device secured to the frame and projecting downwardly therefrom in disposition to engage the skating surface, said third device including a socket structure secured to the frame and spaced forwardly of said second member, there being a semi-circular cavity in the socket structure, and a sphere complementally received in the cavity for rolling movement in any direction, the sphere of said third device projecting downwardly from the frame a shorter distance than the projection of the sphere of said second device.

2. A skate as set forth in claim 1, wherein said first roller device includes a pair of laterally spaced apart wheels, both of said wheels being journalled on said axle for only fore and aft rolling motion with respect to said frame.

3. A skate as set forth in claim 2, wherein both of said wheels are of identical diameter.

4. A skate as set forth in claim 3, wherein said second device includes at least two socket members secured to the frame, said members being spaced apart laterally of the frame and at substantially the same distances from the ends of the frame, each of said members having respective semi-spherical cavities therein, and a sphere complementally received in each cavity for rolling movement in any direction.

5. A roller skate for a skater's shoe comprising:

an elongated frame adapted to be positioned in supporting relationship beneath the shoe sole;

a first spherical ball and socket roller device mounted to the frame intermediate the length of the shoe;

a second spherical ball and socket roller device of lesser diameter than said first device and mounted to the frame forwardly of said first device; and a wheel roller rotatably mounted to the frame rearwardly of said first device for rotation about a fixed axis extending transversely of the frame for fore and aft roller motion with respect to the frame.

6. A skate as set forth in claim 5, wherein said second device includes a pair of spherical ball and socket rollers mounted to the frame in side by side relationship.

7. A skate as set forth in claim 5, wherein said first device includes a pair of spherical ball and socket rollers mounted to the frame in side by side relationship.

8. A skate as set forth in claim 5, wherein said first and second roller devices each include a pair of spherical ball and socket rollers, the rollers of each pair being mounted to the frame in side by side relationship, and wherein said wheel roller includes a pair of spaced apart wheels mounted in side by side relationship for rotation about a common axis.

* * * * *